US005261849A

United States Patent [19]

French

[11] Patent Number: 5,261,849

[45] Date of Patent: Nov. 16, 1993

[54] PUPPET/MARIONETTE THEATER

[76] Inventor: Ellis L. French, 1320 S. Logan St., Denver, Colo. 80210

[21] Appl. No.: 17,474

[22] Filed: Feb. 12, 1993

[51] Int. Cl.[5] ..... A63J 19/00

[52] U.S. Cl. ..... 446/82; 472/57

[58] Field of Search ..... 446/82, 83, 84, 327, 446/328, 329, 359, 361, 362, 363, 366, 367; 472/57, 70, 75, 77

[56] References Cited

U.S. PATENT DOCUMENTS

| | | | |
|---|---|---|---|
| 937,780 | 10/1909 | Eastman | 446/82 X |
| 1,219,099 | 3/1917 | Hart | 446/83 |
| 1,502,236 | 7/1924 | Dondo | 446/84 |
| 2,725,670 | 12/1955 | Hodes | 446/327 |
| 3,060,632 | 10/1962 | Wagner | 446/83 |
| 3,063,193 | 11/1962 | Reinosa | 446/83 |
| 3,742,644 | 7/1973 | Williams | 446/366 |
| 3,762,788 | 10/1973 | Heller | 446/82 X |
| 4,075,780 | 2/1978 | Linebaugh | 446/84 |
| 4,804,348 | 2/1989 | Bondi | 446/366 X |
| 4,962,420 | 10/1990 | Judenich | 472/77 X |

FOREIGN PATENT DOCUMENTS

| | | | |
|---|---|---|---|
| 458623 | 7/1951 | Italy | 446/83 |

*Primary Examiner*—Robert A. Hafer
*Assistant Examiner*—D. Neal Muir

[57] ABSTRACT

A toy or miniature theater is designed for interchangeable use in staging performances, such as, puppet or marionette shows and is made up of a housing with a platform normally disposed at a lower end of the housing with a front opening in the housing above the platform so as to define a stage, one or more side openings being provided to afford access from the sides of the housing in manipulating characters on the stage. The platform includes an opening which can be removably closed so that when the platform is at the lower end of the housing it can form a solid stage and when the housing is inverted to place the platform at the upper end, the housing opening is left open for passage of marionettes or other figures therethrough above the housing and into a position visible through the front opening of the housing. A scenic backdrop in the form of a removable panel can be removably inserted through slots either across the front or rear end of the platform as desired.

7 Claims, 2 Drawing Sheets

PUPPET/MARIONETTE THEATER

This invention relates to a portable stage or play station; and more particularly relates to a portable theater usable by children or adults for creative plays or performances and which is especially useful as a setting for marionette or puppet theater.

BACKGROUND AND FIELD OF INVENTION

Children's theaters are in widespread use not only as a means for recreation but for therapeutic use as well in implementing children to act and play out their fantasies and to challenge their creativity. To this end, it is desirable that the theater be of simplified but sturdy construction, lightweight and portable while affording utmost versatility for different uses, such as, puppets, marionettes and figurines.

Play theaters have been devised in the past which can be interchangeably used for puppet or marionette shows and, for example, reference is made to U.S. Pat. No. 2,718,091 to E. J. Schrock. U.S. Pat. No. 3,762,788 to A. Heller is not adaptable for interchangeable use but does provide a puppet theater which can be used as well as a storage container and includes a removable backdrop for the purpose of creating different scenery. U.S. Pat. No. 4,764,142 to M. Griffith et al discloses a portable stage and kit with changeable curtains, and U.S. Pat. No. 4,075,780 to D. T. Linebaugh discloses a marionette theater with a removable backdrop. Other patents representative of the prior art are U.S. Pat. Nos. 2,620,591 to E. Scola and U.S. Pat. Nos. 3,812,611 and 4,136,665 to M. Bierwiler.

There is a continuing need and demand for a toy theater of the type which is rugged yet highly versatile and is so constructed and arranged as to develop a child's dramatic skills as well as creative instincts. Specifically, it is desirable that the theater be of unitary construction and versatile in the sense that it is adapted for use in acting or playing out stories or skits with different figures including puppets, marionettes, dolls and figurines.

SUMMARY OF THE INVENTION

It is therefore an object of the present invention to provide for a novel and improved miniature theater which is readily conformable for use by children or adults in staging performances using puppets, marionettes or other figurines.

It is another object of the present invention to provide for a novel and improved miniature theater which is lightweight and portable while being of rugged and durable construction and is readily usable by children or adults in staging plays or performances using various types of two-dimensional or three-dimensional characters including but not limited to puppets and marionettes.

It is a still further object of the present invention to provide a toy theater in the form of a rigid, generally rectangular shell and having a stage area which can be transformed for use either in puppet or marionette performances as well as being readily transformable to present different scenic settings and backdrops, all in such a way as to encourage development of a child's dramatic skills and creativity.

In accordance with the present invention, a toy theater has been devised for interchangeable use in staging performances, such as, puppet or marionette shows and which comprises a housing in the form of a rigid outer shell, a horizontal platform normally disposed at a lower end of the shell with a front opening in the shell above the platform, one or more side openings on opposite sides and above the platform, at least one opening in the platform, and means for removably closing the platform opening whereby the platform opening can be closed when the platform is at the lower end of the housing and can be opened when the platform is at the upper end of the housing for passage of marionettes therethrough and into a position visible through the front opening.

In the preferred form, a scenic panel can be removably positioned in front or rear slots located above the platform in opposite sides of the shell and which includes means for presenting different scenery on the panel to serve as a backdrop for the platform stage. Preferably the shell is of generally rectangular configuration and can be constructed of different sizes depending upon the age level of the child or other person for which it is intended.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENTS

Figure 1:
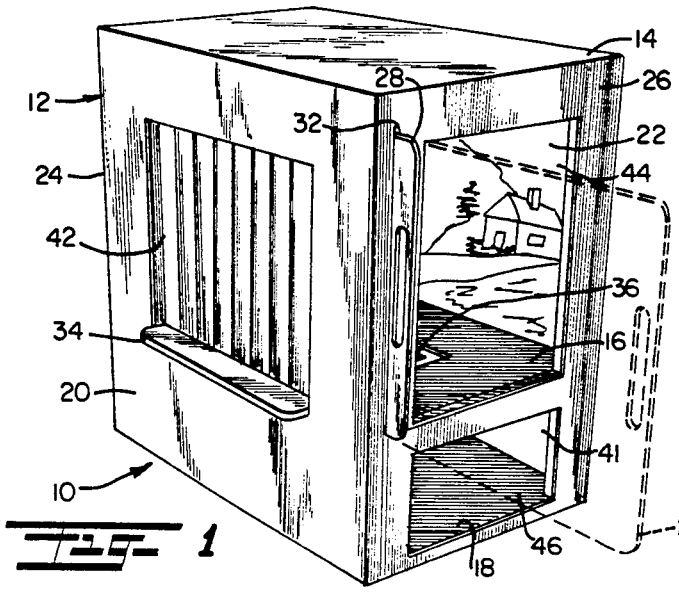
FIG. 1 is a perspective view of a preferred form of theater in accordance with the present invention.
Figure 2:
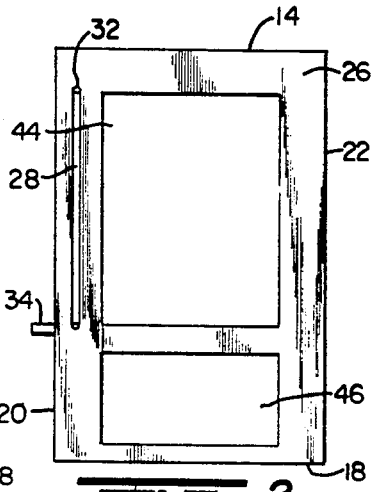
FIG. 2 is a front view in elevation of the preferred form of theater illustrated in FIG. 1.

Referring in more detail to the drawings, a preferred form of theater 10 is illustrated in FIGS. 1 to 10, FIGS. 1 to 5 illustrating the theater 10 in an upright position for use as a puppet theater, and FIGS. 6 to 10 illustrating the theater 10 in an inverted position for use as a marionette theater. It should be understood at the outset that characterization as a puppet or marionette theater is given more for the purpose of illustration and not limitation to demonstrate the versatility of the theater 10. As will become more apparent hereinafter, the theater 10 is so constructed and arranged as to pique the creativity of the child in putting on various different types of plays or performances using virtually any type of two-dimensional or three-dimensional characters including but not limited to puppets, marionettes, dolls and other figurines.

In accordance with the present invention, the preferred form of theater 10 comprises a generally rectangular shell or housing 12 having a top panel 14, intermediate panel or platform 16 and a bottom panel 18. The panel sections 14, 16 and 18 are rigidly interconnected by front and rear vertical panels 20 and 22, respectively, and opposite side panels 24 and 26. A panel 28 is removably insertable into either a rear slot 30 or front slot 32 in opposite side panels 24 and 26 for a purpose to be hereinafter described.

In the preferred form, the panel 16 is of generally rectangular configuration and includes a front extension or ledge 34 and a central recess or cavity 36 also of generally rectangular configuration and which includes a depressed portion 38 surrounding its outer edge to facilitate removable disposition of a tray 40 in the recess. The rear wall panel 22 is of solid rectangular configuration, except for an open area or opening 41 beneath the platform; and the front wall panel 20 is provided with an enlarged central opening 42 which defines the front of the stage with ledge 34 of the platform 16 projecting outwardly beyond the lower edge of the stage opening 42.

The opposite side panels 24 and 26 each correspondingly includes a relatively large rectangular opening 44 above the level of the platform 16 and a smaller opening 46 beneath the platform, the area beneath the platform serving as a storage space.

The preferred form of theater 10 is of wood construction and therefore includes relatively thick reinforcing members including board members 50 and 51 extending horizontally along the upper intersecting edges of the top panel 14 with the front and rear panels 20, 22 and side panels 24, 26. A reinforcing member 52 extends intermediately of the length of the top panel 14 between the front and rear edges. Intermediate reinforcing members 54 and 55 extend along the front and rear panels 20, 22 and side panels 24, 26, respectively, directly beneath the openings 42 and 44 to support the platform 16. Reinforcing board members 56 and 57 extend horizontally along the lower intersecting edges between the bottom panel 18 and the front and rear panels 20, 22 and side panels 24, 26. In turn, vertical reinforcing members 58 extend along the intersecting edges between the front and rear panels 20, 22 and side panels 24, 26. In the wood construction as described, the outer panels 14, 18, 20, 22 and 24, 26 are of a thin veneer construction and therefore require internal reinforcement. However, it will be apparent that the rectangular shell as described may be suitably composed of other materials, such as, plastic of sufficient strength as not to require the internal reinforcing members.

Figure 3:
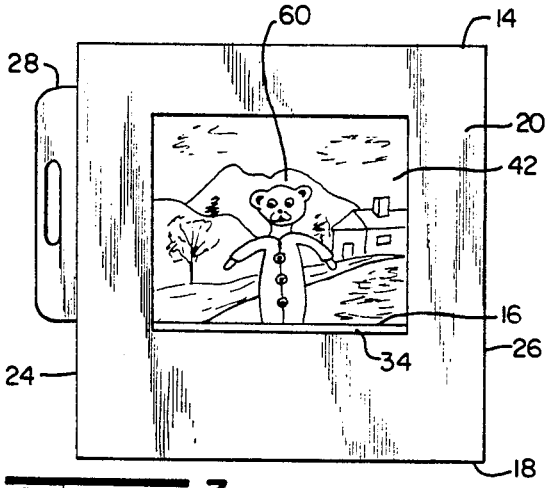
FIG. 3 is a side view in elevation of the preferred form of theater in accordance with the present invention.
Figure 4:
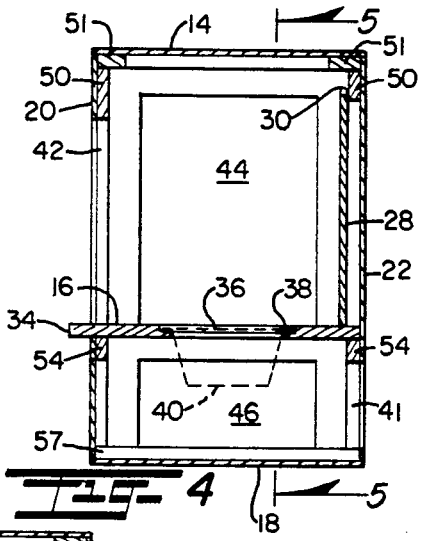
FIG. 4 is a cross-sectional view taken about lines 4—4 of FIG. 2.
Figure 5:
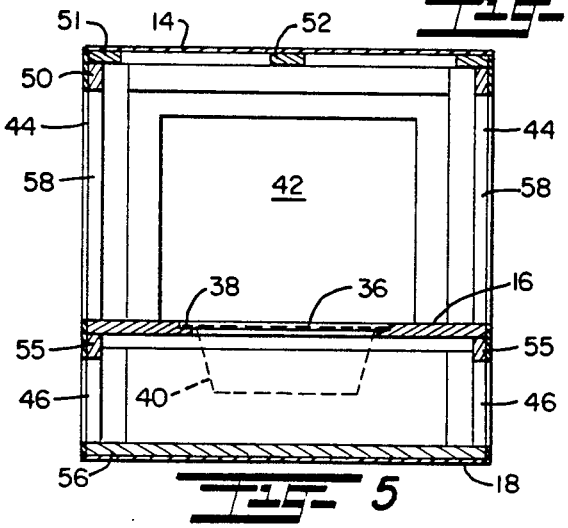
FIG. 5 is a cross-sectional view taken about lines 5—5 of FIG. 4.
Figure 6:
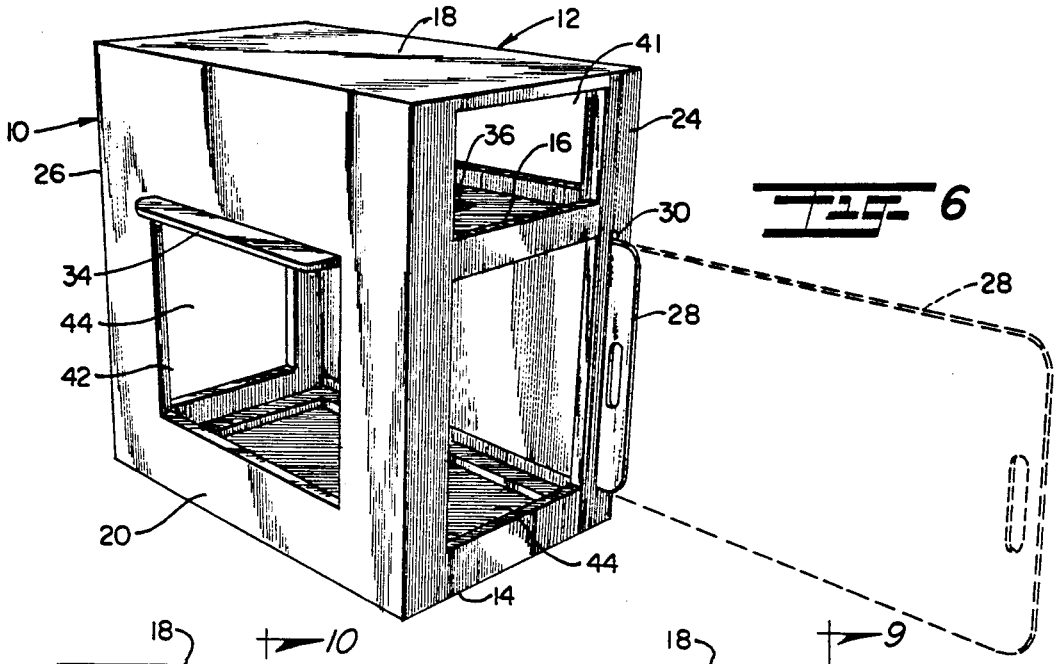
FIG. 6 is a perspective view illustrating the preferred form of theater when inverted for use as a puppet theater.
Figure 7:
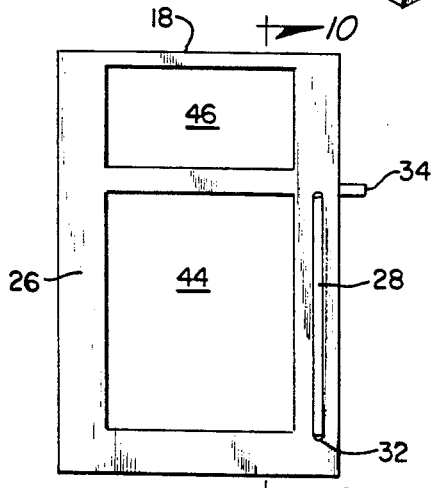
FIG. 7 is a side view in elevation of the theater in the inverted position.

The removable panel 28 is preferably of pressed wood or masonite construction with a surface which will permit one to draw or otherwise affix various scenic backgrounds, such as, illustrated in FIGS. 1 and 3 and generally designated at 60 when placed in the rear slots 30; or, when placed in the forward slots 32 may serve as a curtain or closure in front of the stage. The removable tray 40 for the platform 16 may be used to support various objects of three-dimensional form, such as, toy animals or dolls as stationary objects on the stage; or, if desired, a flat insert may be inserted into the opening 36 in place of the tray to form a solid platform when used as a puppet stage again as illustrated in FIG. 3.

Figure 8:
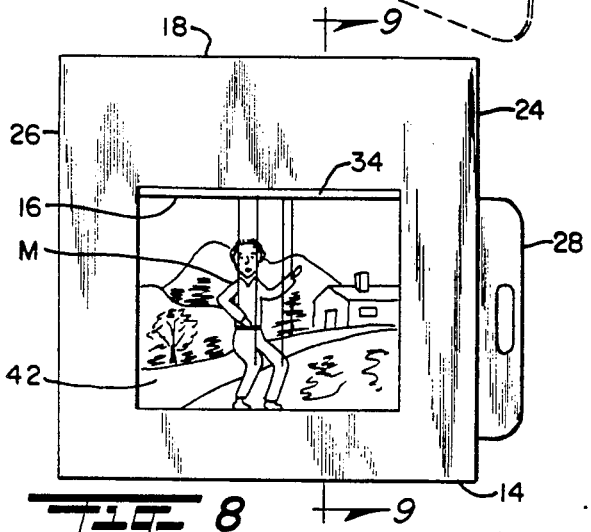
FIG. 8 is a front view in elevation of the theater when inverted as shown in FIGS. 6 and 7.
Figure 10:
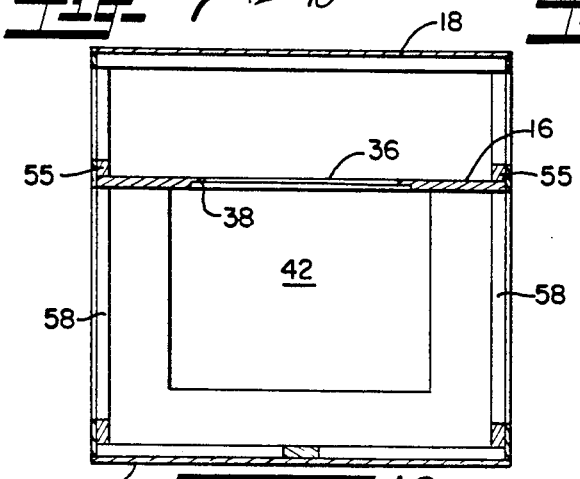
FIG. 10 is a cross-sectional view taken about lines 10—10 of FIG. 9.
Figure 9:
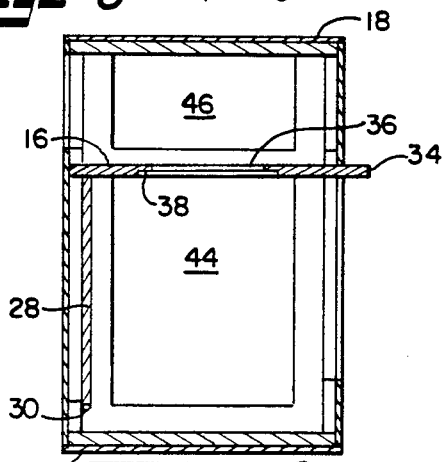
FIG. 9 is a cross-sectional view taken about lines 9—9 of FIG. 8.

FIGS. 6 to 10 illustrate use of the theater in an inverted position with the platform 16 extending above the opening 42. In this position, the tray 40 would of course be removed so as to leave a central opening in the platform for suspension of marionettes as represented at M through the opening 40, as illustrated in FIG. 8. In this position, the storage area which is accessible through the smaller opening 46 beneath the platform is now located above the platform and therefore affords a convenient means of access for manipulation of the marionettes. Once again, however, the removable panel 28 can be inserted through the slots 32 which are now located at the rear of the stage.

From the foregoing, it will be apparent that the theater of the above invention has many different applications and uses other than those described. Although of highly durable construction, it is sufficiently lightweight and portable as to be easily moved; and by virtue of the open shell construction provides ample storage spaces for any props or characters used in staging performances.

Accordingly, while a preferred form of invention is herein set forth and described, it will be understood that various modifications and changes may be made without departing from the spirit and scope of the present invention as defined by the appended claims.

I claim:

1. A toy theater for interchangeable use in staging performances for puppet or marionette shows by turning over said theater, comprising:

a housing in the form of a rigid outer shell including a bottom, a front, rear and opposed sides;

a horizontal platform normally disposed at a lower end of said shell with a front opening in said shell above said platform said platform displaced from said bottom;

one or more additional openings on opposed sides and above said platform;

a removable scenic panel behind said platform and visible through said front opening;

at least one opening in said platform; and means removably closing said platform opening whereby said platform opening enables puppet use when said platform is at the lower end of said housing enables marionette use when said theatre is turned over and said platform is at the upper end of said housing permitting passage of marionettes therethrough and into a position visible through said front opening.

2. A theater according to claim 1, said scenic panel being removable.

3. A theater according to claim 2, including means for presenting different scenery on said scenic panel.

4. A theater according to claim 1, said shell being of generally rectangular configuration having opposite sides flanking said platform and rear slots in said sides for slidable insertion of said rear panel therethrough.

5. A theater according to claim 4, including front aligned slots for slidable insertion of a panel therethrough.

6. A theater according to claim 1, said closing means including a storage tray removably disposed in said cavity.

7. A theater according to claim 4, including a storage area defined between said platform and said bottom of said theater.

* * * * *